United States Patent [19]

Nose et al.

[11] 4,204,653

[45] May 27, 1980

[54] NON-UNIFORMLY WOUND YARN PACKAGE

[75] Inventors: Kenkichi Nose; Toshihumi Mikumo, both of Matsuyama, Japan

[73] Assignee: Teijin Limited, Osaka, Japan

[21] Appl. No.: 33,134

[22] Filed: Apr. 25, 1979

[30] Foreign Application Priority Data

May 9, 1978 [JP] Japan ..... 53/54040

[51] Int. Cl.[2] ..... B65H 55/04

[52] U.S. Cl. ..... 242/178; 242/26.3; 242/43.1

[58] Field of Search ..... 242/178, 177, 176, 159, 242/26.1, 26.2, 26.3, 43 R, 43.1

[56] References Cited

U.S. PATENT DOCUMENTS

| | | | |
|---|---|---|---|
| 2,285,438 | 6/1942 | Jones | 242/178 |
| 2,296,420 | 9/1942 | Campbell | 242/177 |
| 2,764,363 | 9/1956 | Stammwitz | 242/26.2 |
| 2,980,362 | 4/1961 | Goddard | 242/176 |
| 3,243,131 | 3/1966 | Greive | 242/26.3 |
| 3,259,337 | 7/1966 | De Ruig | 242/178 |
| 3,367,588 | 2/1968 | Wolf | 242/26.3 |
| 3,695,529 | 10/1972 | Hori et al. | 242/26.3 |

*Primary Examiner*—Stanley N. Gilreath

*Attorney, Agent, or Firm*—Burgess, Ryan and Wayne

[57] ABSTRACT

A yarn package which is provided with a saw-shaped traverse stroke profile, similar in some respects to that of a pine cone, and to a method for winding the same. This shape, by providing a periodic variation in the effective winding height, minimizes irregularities in the yarn due to compression and relaxation stresses.

15 Claims, 9 Drawing Figures

TRAVERSE STROKE
TIME
Af
6
A'f
Af-1
A4
4 5
A3
A'3
Bf
Bf-1

TRAVERSE STROKE
TIME
Af
3
2
A3
1
A1
A2
LD
L
Bf
B1 B2 B3

NON-UNIFORMLY WOUND YARN PACKAGE

BRIEF DESCRIPTION OF THE INVENTION

This invention relates to a filament yarn package, especially to a construction of a pirn which is formed by winding a filament yarn on a bobbin in a cylindrical shape with cones at each end thereof.

BACKGROUND OF THE INVENTION

When a filament yarn, particularly a thermoplastic synthetic filament yarn, is wound on a bobbin to form a yarn package by means of a conventional ring twister or a conventional draw-twister, a twist ring is vertically reciprocated along a bobbin inserted onto a rotatable projecting spindle and the traverse stroke thereof or the winding position thereof is successively changed from the initial winding condition to the final winding condition (this is called a building motion or traverse motion) so that a package is formed on the bobbin.

Traverse apparatus disclosed in prior references, for example, Japanese Patent Publication No. 21942/66, Japanese Utility Model Publication No. 42181/77 and U.S. Pat. No. 3,695,529, have been utilized as apparatus for winding a filament yarn into a package. Consequently, filament yarns have been wound into packages in accordance with various kinds of traverse methods, such as warp winding, parallel winding or wandering winding.

A filament yarn, especially a synthetic filament yarn, wound in accordance with any one of such winding methods, however, has a defect in that, when it is utilized in knitted fabrics or woven fabrics, especially as a warp yarn of woven fabrics, bright specks may frequently occur. It has been known that the bright specks are caused by nonuniformity of yarn quality due to the change in quality of a filament yarn wound on a bobbin. It has also been known that nonuniformities of yarn are generated between an end portion and a central portion of the package, and between an inner, an intermediate and an outer portion of the package, and especially, that a filament yarn located at the inner portion has a large amount of nonuniformity between the end portion and the central portion thereof. This is because, in the filament yarn located at the inner portion adjacent to the bobbin, the stress relaxation does not occur freely since the filament yarn at the inner portion is prevented from contraction by the bobbin, and the stress relaxation in the filament yarn located at the outer or the end portion of the package is small since the compressive force from the outside is small. On the other hand, the filament yarn located at the central and intermediate portion is compressed strongly from the outside thereof, and therefore, a large amount of stress relaxation is caused. Consequently, it has been concluded that, in the filament yarn located at the intermediate portion, the difference in the stress relaxations between in the yarns located at the end portion and the central portion is very large and that, as a result, nonuniformity of yarn quality which causes bright specks is generated.

A winding method is known wherein a yarn is wound around a bobbin by utilizing a winding pattern wherein the traverse stroke is successively increased from the commencement of the winding to the completion of the winding (see U.S. Pat. No. 2,980,362). The term "winding pattern" means a shape surrounded by envelopes of the uppermost and lowermost traverse strokes when time is plotted on an abscissa and the traverse stroke is plotted on an ordinate. However, if a yarn package is wound on a bobbin by utilizing such a winding pattern, the weight of the wound package must be very small, or the package cannot be fully wound on the bobbin.

SUMMARY OF THE INVENTION

The principal object of the present invention is to provide a yarn package which will not cause bright specks when the wound yarn is utilized for knitted fabrics or woven fabrics and which will not become out of shape even when the weight of the wound yarn is large.

The above-mentioned principal object of the present invention is achieved by a yarn package wound on a bobbin by the largest traverse stroke at the final traverse motion, wherein during the winding operation thereof, at least, for one time the traverse stroke is decreased to a second traverse stroke by a certain amount from a first traverse stroke which takes place just before the commencement of the decrease of the traverse stroke, and then, the traverse stroke is increased to a third traverse stroke larger than the first traverse stroke.

BRIEF DESCRIPTION OF THE DRAWINGS

The present invention will now be explained in detail with reference to accompanying drawings, wherein.

DETAILED DESCRIPTION OF THE INVENTION

In the following explanation, the yarn packages described in the embodiments are wound on bobbins by means of a traverse apparatus described in the above-mentioned U.S. Pat. No. 3,695,529. The traverse apparatus includes a winding pattern plate connected to a hydraulic cylinder and reciprocally moved in synchronism with the traverse motion thereby, and a sensor means for detecting edges of the winding pattern plate and for emitting a change over signal to the hydraulic cylinder, whereby the width of the winding pattern plate in a traverse direction determines the traverse stroke of the yarn package. However, it should be noted that a yarn package of the present invention can be wound by means of not only the above-mentioned traverse apparatus but, also, any other known traverse apparatus if it is possible to vary the traverse motion.

Figure 1A:
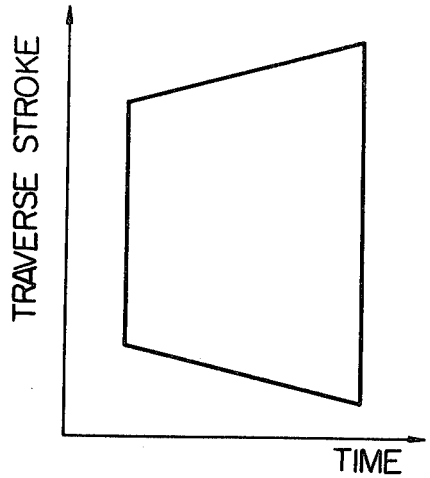
Fig. 1A PRIOR ART
FIGS. 1A through 1C illustrate a winding pattern, a traverse motion diagram and a cross sectional view of a yarn package, i.e., a pirn, of a conventional reverse warp winding, respectively.
Figure 1B:
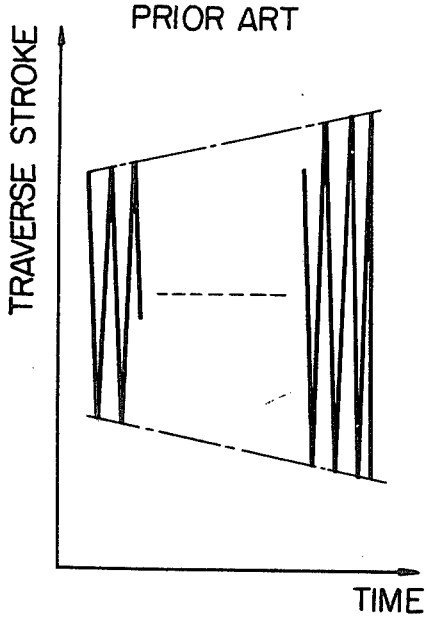
Fig. 1B PRIOR ART
Figure 1C:
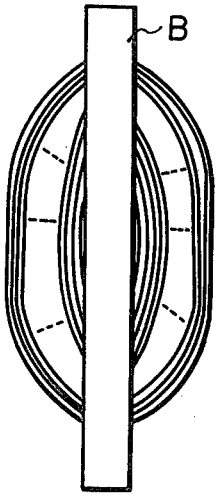
Fig. 1C PRIOR ART

Referring to FIGS. 1A and 1B, wherein time is plotted on the abscissa and the traverse stroke is plotted on the ordinate, a winding pattern and a traverse motion are illustrated, respectively, wherein the traverse stroke is successively increased from the commencement of the winding so that the final winding stroke is the largest. A yarn package wound on a bobbin B in accordance with such a winding pattern is illustrated in FIG. 1C. The yarn wound on the yarn package is free from bright specks, but the yarn package frequently gets out of shape. As a result, the amount of the yarn wound on the bobbin must be very small.

Figure 2B:
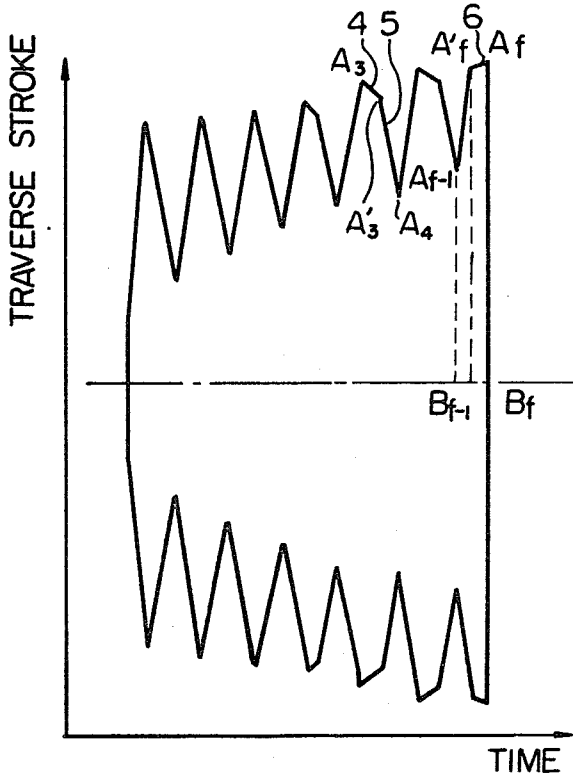
FIGS. 2A through 2D are examples of winding patterns utilized for winding yarn packages according to the present invention.
Figure 2A:
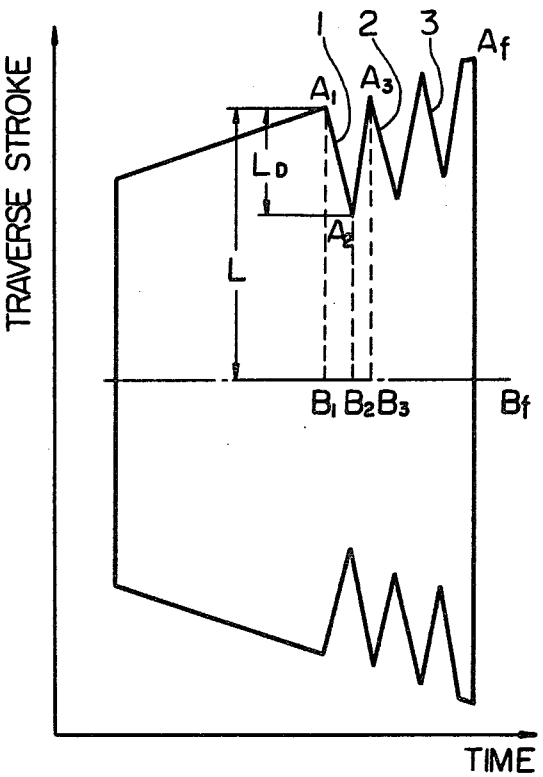
Figure 2D:
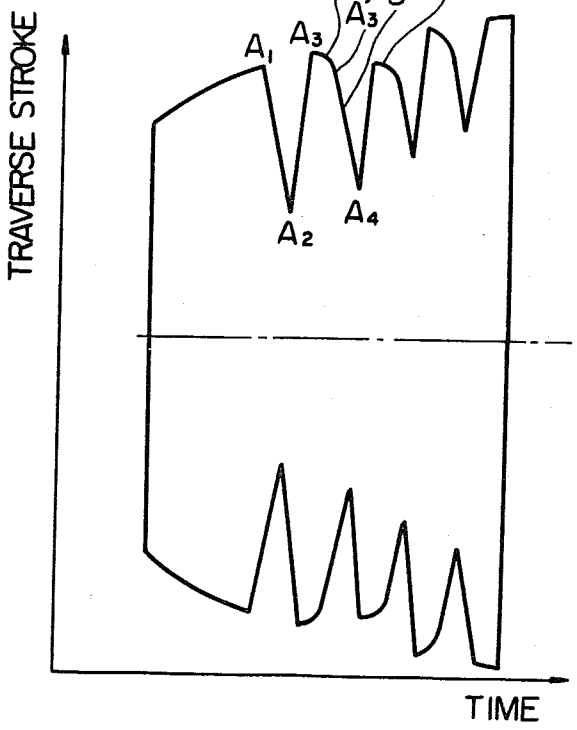
Figure 2C:
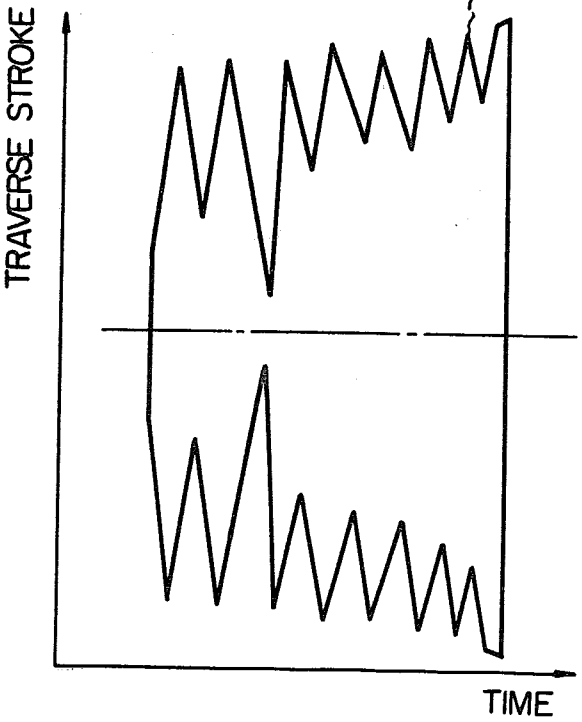

FIG. 2A is a winding pattern which is utilized for winding a yarn package according to the present invention and which has three pairs, 1, 2 and 3, of successive increase and decrease of the traverse stroke during the winding operation. FIGS. 2B through 2D are winding patterns which are also utilized for winding yarn packages according to the present invention and which are obtained by modifying the winding pattern of FIG. 2A.

Some winding conditions and requirements of the present invention will now be explained. It is preferable that the amount of the decrease of the traverse stroke in the winding pattern for a yarn package of the present invention be at least 15 percent of the traverse stroke at the commencement of the decrease of the traverse stroke. More specifically, referring to FIG. 2A the amount of the decrease $L_D$ in the first pair 1 of the decrease and increase of the traverse stroke is at least 15 percent of the traverse stroke L at the commencement of the decrease of the traverse stroke which is designated by a broken line $A_1B_1$, and; the amount of the decrease in the second pair 2 of decrease and increase of the traverse stroke is at least 15 percent of the traverse stroke designated by a broken line $A_2B_2$ at the commencement of the decrease. The inventors of the present invention have confirmed that, if the amount of the decrease of the traverse stroke is less than 15 percent of the traverse stroke at the commencement of the decrease, the amount of the yarn wound on a bobbin is often not very large. In other words, one of the desired objects of the present invention cannot be fully achieved. On the other hand, there is no upper limit regarding the amount of the decrease of the traverse stroke if the amount of the decrease of the traverse stroke does not exceed 100 percent. In some cases, the amount of the decrease may be almost 100 percent of the traverse stroke at the commencement of the decrease.

If the decreasing rate of the traverse stroke from the traverse stroke $A_3$, at the commencement of the decrease, to a certain traverse stroke $A'_3$, between the traverse stroke at the commencement of the decrease $A_3$ and the traverse stroke $A_4$ at the completion of the decrease, is selected so that it is smaller than the decreasing rate of the traverse stroke from the traverse stroke $A'_3$ to the traverse stroke $A_4$ at the completion of the decrease, as illustrated in FIGS. 2B and 2D by reference numerals 4 and 5, respectively, the amount of the yarn wound on a bobbin can be increased. It is preferable that the difference in the stroke between $A_3$ and $A'_3$ be equal to or less than one third of the difference in the stroke between $A_3$ and $A_4$.

It is preferable that, after the completion of the decrease of the traverse stroke, the traverse stroke be again increased to a traverse stroke $A_3B_3$ which is larger than the traverse stroke $A_1B_1$ at the commencement of the decrease and which is smaller than the final traverse stroke $A_fB_f$ (see FIG. 2A). If the traverse stroke is not recovered to the traverse stroke $A_1B_1$ at the commencement of the decrease, the yarn package may be deformed. To prevent deformation of the package, the weight of the package must be small. On the other hand, if the traverse stroke is recovered to a value exceeding the final traverse stroke $A_fB_f$, not only can the amount of the package not be increased but, also, bright specks may be caused when the yarn wound on the package is utilized for knitted fabrics or woven fabrics.

In some cases, the traverse stroke may be increased after a certain time interval from the completion of the decrease of the traverse stroke. It is preferable, however, that the traverse stroke be increased just after the completion of the decrease of the traverse stroke, because the weight of the yarn package can then be increased and because the package will be good for the handling thereof.

As the number of pairs of decrease and increase of the traverse stroke becomes high, the effect for increasing the amount of the package becomes large. Therefore, it is preferable that the number be at least three. There is no upper limit of the number. However, even if the number is extremely high, for example more than twenty, the effect for increasing the weight of the yarn package will be maintained at a certain value.

When a plurality of pairs of decrease and increase of the traverse stroke take place, in some cases each pair may occur discontinuously, however, if they occur successively, in other words the winding pattern has a saw shape, as illustrated in FIGS. 2A through 2D, the increase of the amount of the yarn package can be achieved easily. Therefore, it is preferable that the pairs of decrease and increase occur successively.

In the case wherein pairs of decrease and increase of the traverse stroke is at least two, especially more than two, it is preferable that the amounts of the decrease of the stroke are successively decreased as illustrated in FIG. 2B. This is because the yarn package then becomes good for the handling thereof and the increase of the amount of the yarn package can be large.

Referring to FIG. 2B, the increasing rate of the traverse stroke occuring from the traverse stroke $A'_f$, between the last decreased stroke $A_{f-1}$ and the last increased stroke $A_f$, during the final increase of the traverse stroke, is smaller than the increasing rate between $A_{f-1}$ and $A'_f$. The smaller increasing rate portion of the winding pattern designated by reference numeral 6 in FIG. 2B is almost the same as the maximum traverse stroke portion of the original pattern, and the portion can be utilized for adjusting the weight of the yarn package by changing the finishing timing of winding operation, i.e., time duration for winding the yarn package. It is preferable that the difference in the stroke between $A'_f$ and $A_{f-1}$ be equal to or less than one third of the difference in the stroke between $A_{f-1}$ and $A_f$.

Many conditions required for the winding pattern utilized for winding a yarn package according to the present invention have been explained hereinbefore. However, it should be noted that, when at least two pairs of decrease and increase of the traverse stroke take place, as long as at least one pair of decrease and increase of the traverse stroke satisfies the above-mentioned requirements, there may be some pairs of decrease and increase of the traverse stroke which do not satisfy the above-mentioned requirements, i.e., the amount of the decrease of the traverse stroke does not reach 15 percent of the traverse stroke at the commencement of the decrease, as designated by reference numeral 7 in FIG. 2C; or the amount of the traverse stroke at the completion of the increase does not reach that of the traverse stroke at the commencement of the decrease, as designated by reference numeral 8 in FIG. 2D.

It is preferable that a number of pairs of decrease and increase of the traverse stroke take place at both ends of the bobbin, i.e., at the upper and lower ends of the bobbin. While, in some cases, the pairs of decrease and increase may take place at only one end of the bobbin, it is preferable that the shape of pairs of decrease and increase of the traverse stroke be symmetrical with respect to the center of the traverse stroke, at the upper and lower ends of a bobbin. This is because, if the shape of the pairs is symmetrical, a sufficient increase in the weight of the yarn package can be achieved and the shape of the yarn package will be good for the handling thereof.

Many kinds of bobbins can be utilized for winding yarn package thereon according to the present invention. However, it should be noted that, if the surface of a bobbin is too hard, bright specks may be caused when a synthetic filament yarn wound on the bobbin is utilized for knitted fabric or woven fabrics. On the other hand, if the surface of a bobbin is too soft, the bobbin may be deformed when a yarn is tightly wound thereon. The inventors of the present invention found that bobbins having a surface hardness between 8 and 140 are preferable. The method for measuring the surface hardness of a bobbin will be explained later.

The present invention is applicable for winding any kinds of filament yarns for increasing the weight of the yarn package. It should be pointed out that if the present invention is applied for winding a drawn synthetic filament yarn, for example, a filament yarn of a polyester, such as polyethylene terephthalate, a filament of a polyamide such as nylon 6 or nylon 66, or a filament yarn of a polyacrylonitrile, not only an increase in the weight of the yarn package but, also, the prevention of bright specks can be realized.

Since the package according to the present invention is surrounded by an outermost surface which is formed by the largest final traverse stroke, when the outer surface of the package is damaged, for example, during handling thereof, the damaged outer surface is removed from the yarn package, and then, the remaining package can be utilized as a package having a normal quality.

Figure 3:
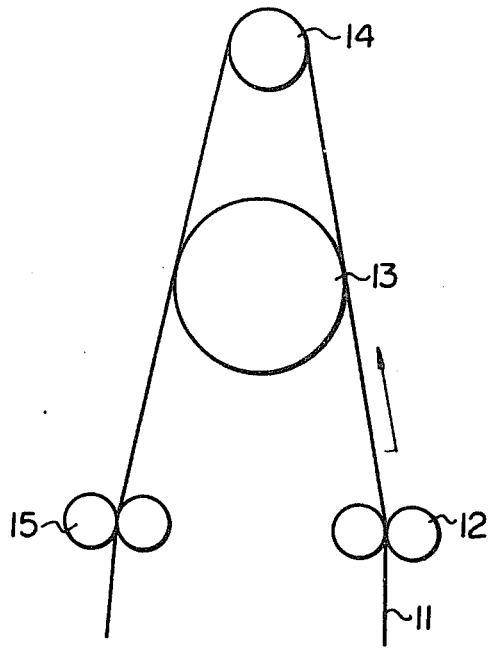
FIG. 3 is a diagrammatical view of a device utilized for measuring thermal stress of a yarn.
Figure 4:
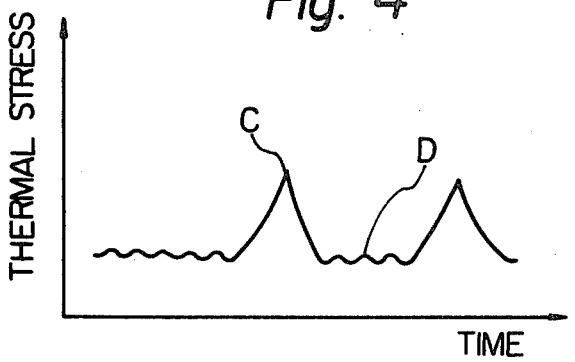
FIG. 4 is a thermal stress diagram obtained by utilizing the device illustrated in FIG. 3.

Some examples of the present invention will be explained in detail hereinafter. In the following description, the term "full package ratio" means the percentage of the number of full packages to the number of prepared bobbins. All the bobbins utilized have a length of 380 mm and a diameter of 50 mm. The surface hardness of the bobbins is measured by utilizing a standard type Rockwell hardness tester, manufactured by Mori Seisakusho, wherein a steel ball having a diameter of one-half inch is pressed for 20 seconds against the surface of the test pieces, having a square shape of 25 mm×25 mm obtained from the bobbins, with a measuring pressure of 15 kg, and the obtained data of depth in millimeters are converted into surface hardness by multiplying the obtained data by 100. Differences in the stress relaxation in the yarn, which are known to be the cause of bright specks, are measured by utilizing a device illustrated in FIG. 3. In FIG. 3, reference numeral 11 designates a running filament yarn, reference numeral 12 designates a pair of feed rollers, reference numeral 13 designates a heater with which the running yarn is in contact over a 10 mm length at both sides of the heater and which is maintained at 100° C., reference numeral 14 designates a pick up roll of an instrument for measuring stress, and reference numeral 15 designates a pair of take up rollers, the peripheral speed of which is 30 m/min and is faster than the pair of feed rollers 12 by 5 percent. FIG. 4 is a thermal stress diagram obtained by utilizing the device illustrated in FIG. 3. In FIG. 4, the value of the thermal stress of the filament yarn located at the end portion of a yarn package is designated by C, and the minimum value of the thermal stress of the filament yarn located at the intermediate portion between the end portions of the package is designated by D. Consequently, the difference between C and D is the variation of thermal stress. The inventors of the present invention have confirmed, based on a number of experiences conducted under their supervision, that if the variation of thermal stress is equal to or less than 0.14 g/de, no bright specks will occur when the yarn was utilized for woven fabrics. All the yarn packages measured for their thermal stress were maintained in a controlled environment, wherein the relative humidity was 70 percent and the temperature was 40° C., for two days after they were wound. The thermal stress was measured at the yarn located away from the innermost layer of each yarn package by a distance equal to 20 percent of thickness of the yarn package.

COMPARISON 1

A filament yarn of polyethylene terephthalate was wound on bobbins of paper having a surface hardness of 80 in accordance with a warp winding wherein the traverse stroke was successively decreased from the commencement of the winding under the conditions that the draw ratio was 3, the draw speed was 1200 m/min and the rotational speed of the bobbins was 12000 r.p.m. The filament yarn wound on the bobbins was 75 denier/36 filaments, and had a strength of 5.5 g/de, an elongation of 30 percent and a shrinkage measured in boiling water of 8.5 percent.

When the weight of yarn in the package was 2.5 kg/bobbin, the full package ratio was 100 percent. When the weight of yarn in the package was increased to 2.7 kg/bobbin, the full package ratio became only 75 percent. The variation of thermal stress was 0.24 g/de, which is larger than the above-mentioned critical value.

EXAMPLE 1

A filament yarn was wound on bobbins under the same winding conditions as those described in comparison 1, except that the winding pattern illustrated in FIG. 2B was utilized. When the amount of yarn in the package was 2.7 kg/bobbin, the full package ratio was 100 percent, and this result could be obtained stably. The variation of thermal stress was 0.11 g/de.

EXAMPLES 2 THROUGH 5

A yarn was wound on bobbins under the same conditions as those in example 1, except that the bobbins were made of aluminum with a paper sleeve inserted thereon and that the surface hardness of the bobbins was selected in accordance with Table 1. The weight of yarn in all of the yarn packages was 2.7 kg/bobbin. The results obtained are described in Table 1. As will be understood from Table 1, both the full package ratio and the variation of thermal stress were preferable for practical use.

Table 1

| | Surface hardness | Full package ratio | Variation of thermal stress |
|---|---|---|---|
| Example 2 | 8 | 100% | 0.13 g/de |
| Example 3 | 10 | 100% | 0.12 g/de |
| Example 4 | 130 | 100% | 0.10 g/de |
| Example 5 | 140 | 100% | 0.11 g/de |

COMPARISON 2

A filament yarn was wound on bobbins under the same conditions as those described in Example 1, except that a winding pattern illustrated in FIG. 1A was utilized, so that the traverse stroke was successively increased from the commencement of the winding. The yarn packages frequently got out of shape, and the maximum amount of the yarn in the packages was 1.7 kg/bobbin. Furthermore, when the amount of the yarn in the package was 1.5 kg/bobbin, a full package ratio of 80 percent was obtained.

EXAMPLE 6

A filament yarn of polyethlene terephthalate was wound on bobbins of aluminum, with a plastic sleeve inserted thereon and having a surface hardness of 5, in accordance with the winding pattern illustrated in FIG. 2B, under the conditions that the draw ratio was 5, the draw speed was 600 m/min and the rotational speed of the bobbins was 8000 r.p.m. The filament yarn wound on the bobbins was 250 denier/24 filaments, and had strength of 6 g/de, an elongation of 27 percent and a shrinkage measured in boiling water of 6 percent. The full package ratio was 98 percent when the amount of the yarn in the packages was 2.7 kg/bobbin. The ratio was very good for practical production of yarn packages. The variation of thermal stress was 0.12 g/de. Although the surfaces of the bobbins were hard, the variation of the thermal stress was preferable because the wound filament yarn had a property of low shrinkage.

What we claim is:

1. A yarn package comprising a yarn wound on a bobbin with a traverse stroke back and forth along the axis of the bobbin, the largest traverse stroke being the final traverse stroke in forming the package, wherein during the winding operation thereof, at least for one time the traverse stroke is decreased to a second traverse stroke by a certain amount from a first traverse stroke, which is just before the commencement of the decrease of the traverse stroke, and then, the traverse stroke is increased to a third traverse stroke larger than said first traverse stroke.

2. A yarn package according to claim 1, wherein said amount of the decrease of the traverse stroke is at least 15 percent of said first traverse stroke.

3. A yarn package according to claim 2, wherein the increase of the traverse stroke successively follows said decrease of the traverse stroke.

4. A yarn package according to claim 2, wherein pairs of said decrease and increase of the traverse stroke occur at least three times.

5. A yarn package according to claim 4, wherein said pairs of decrease and increase occur successively.

6. A yarn package according to claim 4, wherein the amount of the decrease of the traverse stroke is successively decreased.

7. A yarn package according to claim 2, wherein a decreasing rate of the traverse stroke from said first traverse stroke to a fourth traverse stroke between said first and said second traverse strokes is smaller than a decreasing rate of the traverse stroke from said fourth traverse stroke to said second traverse stroke.

8. A yarn package according to claim 7, wherein the difference between said first traverse stroke and said fourth traverse stroke is at most one third of the difference between said first traverse stroke and said second traverse stroke.

9. A yarn package according to claim 2, wherein during the final increase of the traverse stroke, an increasing rate of the traverse stroke from a fifth traverse stroke between said second and third traverse stroke to said third traverse stroke is smaller than an increasing rate of the traverse stroke from said second traverse stroke to said fifth traverse stroke.

10. A yarn package according to claim 9, wherein the difference between said fifth traverse stroke and said third traverse stroke is at most one third of the difference between said second traverse stroke and said third traverse stroke.

11. A yarn package according to claim 2, wherein said increase and decrease of the traverse stroke is substantially symmetrical with respect to the center of the traverse stroke of said package.

12. A process for winding a yarn package on a bobbin, comprising the steps of:

providing relative rotational motion between the yarn and the bobbin about the bobbin longitudinal axis;

causing the yarn to be fed to the bobbin along a path generally transverse to said longitudinal axis;

reciprocating said path with a series of successive traverse strokes between the ends of said bobbin to wind said yarn on said bobbin, a first of said traverse strokes having a given amplitude, a second of said traverse strokes following said first traverse stroke having an amplitude less than said given amplitude, and a third of said traverse strokes following said second traverse stroke having an amplitude greater than said given amplitude, whereby said yarn package is provided with a variation in effective winding height which minimizes irregularities in the yarn due to compression and relaxation stresses.

13. The process according to claim 12, comprising the additional step of repetitively varying the amplitudes of said series of traverse strokes to provide a yarn package having a shape corresponding to a series of stacked generally frustoconical sections.

14. The process according to claim 12, wherein the amplitude of said second traverse stroke is at least 15% less than said given amplitude.

15. A yarn package made by the process of claim 12, 13 or 14.

* * * * *